United States Patent [19]

Filip

[11] Patent Number: 4,873,807

[45] Date of Patent: Oct. 17, 1989

[54] ROOF INSULATING AND WATERPROOFING METHODS AND STRUCTURES

[76] Inventor: Stanislaw Filip, 141 Davisville Ave. Apt. 806, Toronto, Ontario, Canada, M4S 1G7

[21] Appl. No.: 250,067

[22] Filed: Sep. 28, 1988

[30] Foreign Application Priority Data

Sep. 30, 1987 [GB] United Kingdom ..... 8722939

[51] Int. Cl.[4] ..... E04B 1/00

[52] U.S. Cl. ..... 52/408; 52/410; 52/741

[58] Field of Search ..... 52/408, 404, 741, 746, 52/748; 404/80, 95

[56] References Cited

U.S. PATENT DOCUMENTS 3,891,585 6/1975 McDonald ..... 404/52 X
3,965,633 6/1976 Carroll ..... 52/410 X
4,007,995 2/1977 Rofidal ..... 404/77
4,113,401 9/1978 McDonald ..... 404/75

*Primary Examiner*—Carl D. Friedman
*Assistant Examiner*—Creighton Smith
*Attorney, Agent, or Firm*—Sim & McBurney

[57] ABSTRACT

An insulating and waterproofing structure for a generally horizontal roof includes an insulating layer of heat-resistant synthetic resin foam which is placed on the roof. The foam has at least a partially open-celled structure at an upper surface of the insulating layer. Molten tar is spread over the insulating layer to a thickness of only a few millimeters, and gravel is then spread over the tar layer. The tar is then heated sufficiently to penetrate and bond with the upper surface of the insulating layer and also to be drawn upwardly through the gravel layer by adhesive and capillary-type forces to form a bond with the gravel. The result is a subtantially unitary structure which insulates and waterproofs the roof while minimizing the tendency for the gravel to displace.

7 Claims, 1 Drawing Sheet

ROOF INSULATING AND WATERPROOFING METHODS AND STRUCTURES

FIELD OF THE INVENTION

The invention relates to the insulating and waterproofing of roofs, and more specifically, to methods and structures appropriate for generally horizontal roofs.

DESCRIPTION OF THE PRIOR ART

Inclined roofs are commonly made resistant to entry of rain with tar paper and an overlying layer of overlapped shingles. However, horizontal roofs receive a substantially different treatment since rain cannot drain as readily owing to lack of any significant measure of inclination.

Current practices regarding insulating and waterproofing of generally horizontal roofs involve forming an insulating layer of styrofoam over the roof structure. Rolled tar paper is then placed over the styrofoam in overlapping strips. Tar in a molten state is then poured and spread over the tar paper to form an appropriate waterproofing layer. The tar paper provides a measure of thermal insulation which prevents immediate melting of the underlying styrofoam, and steps may be taken to ensure that the tar is not excessively hot and cools quickly to a relatively solid state. Lastly, gravel is deposited on the cooled tar to protect the tar layer from degradation with sunlight.

A principal problem with such an arrangement is that the gravel is loose and tends to be lost to the wind and strong rains. In time, the tar layer tends to be exposed to greater degrees to sunlight and ultimately degrades.

BRIEF SUMMARY OF THE INVENTION

It is an object of the present invention to provide methods of forming insulating and waterproofing structures which better retain a protective gravel layer.

It is another object of the invention at least in preferred form to provide a strongly-bonded insulating and waterproofing structure for a generally horizontal roof and associated methods of application.

It is another object of the invention to provide a method of forming an insulating and waterproofing layer which is simpler than the conventional practices identified above.

According to the invention, a roof insulating and waterproofing structure comprises an insulating layer of heat-resistant foam material formed over the roof. A layer of tar is formed over the insulating layer, and gravel is then deposited onto the tar layer. The tar layer is then heated until the tar is very fluid-like. The inventor has discovered that if the tar is heated sufficiently a capillary-type or adhesive action will draw the tar upwardly through the gravel and will envelop lower portions of the gravel forming a bond with the gravel layer itself. If the foam has at least a partially open-celled structure at its upper surface, the heating will normally be sufficient also to cause the tar to peneterate the upper surface of the insulating layer to bond with the foam material. It has also been discovered that very little tar is required in such a process, and that effective bonds can be formed with tar spread to an average thickness of less than about 2 millimeters prior to the heating step.

A principal advantage and result is that the gravel is very effectively bonded to the tar layer. Another very significant advantage and result is that all three layers, namely, foam material, tar and gravel, can be effectively bonded together to define essentially a unitary protective and insulating structure. Use of tar paper and associated labour are eliminated, and very little tar is required to obtain a very effective measure of waterproofing and bonding.

Various aspects of the invention will be more specifically defined in the appended claims.

DESCRIPTION OF THE DRAWINGS

The invention will be better understood with reference to drawings in which.

DESCRIPTION OF A PREFERRED EMBODIMENT

Figure 1:
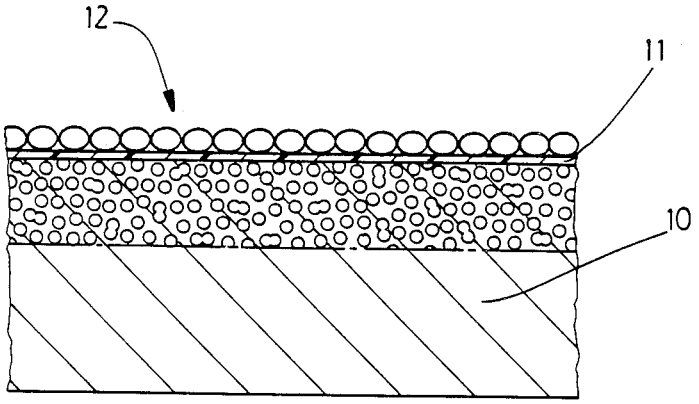
FIG. 1 illustrates a roof insulating and waterproofing structure prior to heat treatement.

FIG. 1 shows a roof insulating and waterproofing structure comprising a layer 10 of foamed thermosetting synthetic resin. This layer 10 may be constructed of individual rectangular panels abutted in side-by-side relationship on a near horizontal roof structure (not illustrated). An appropriate foam material is described in U.S. Pat. No. 4,119,583 which issued on Oct. 10, 1978 to Stanislaw Filip. The principal characteristics of this foam pertinent to the present invention are exceptionally good heat resistance and non-flammability. The foam may be made with about 20 percent open cells, the exact percentage not being unduly critical. Other appropriate foam materials wll be apparent to those familiar with synthetic resins and the like.

In FIG. 1, a coating or layer 11 of tar has been melted and spread over the upper surface of the insulating layer 10. It is noteworthy that no intermediate layer of tar paper is required, as in prior practices. The thickness of the tar layer 11 relative to the insulating layer 10 has been exaggerated for purposes of illustration. The average thickness of the tar layer would typically be less thant about 5 millimeters; however, thickness of less than about 2 millimeters achieve effective bonding of the various layers and effective waterproofing. A layer 12 of gravel is then deposited onto the tar layer 11.

Figure 2:
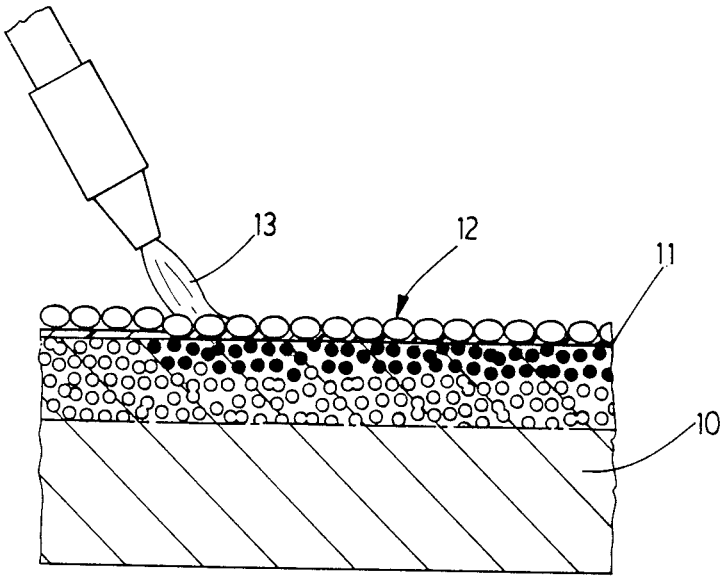
FIG. 2 illustrates the structure subsequent to heating.

In FIG. 2, a gas flame 13 has been passed over the gravel layer 12 of the structure of FIG. 1 to melt the tar layer 11. Heat is applied until the tar layer 11 is sufficiently fluid in nature that adhesive forces and capillary action between proximate gravel particulates draw the tar upwardly about the gravel particulates. At the same time, the fluidizied tar layer 11 is absorbed into the upper surface of the insulating layer 10, entering the open cells of the synthetic resin material. The insulating layer 10 must be formed of a material which is sufficiently heat-resistant to avoid melting or burning during the heating process. Conventional styrofoam as used in prior practices is inappropriate.

Certain advantages associated with the described method and the resulting structure should be noted. First, the gravel particulates are partially enveloped by the tar layer 11 and effectively bonded thereto. This ensures that the gravel layer 12 is not readily dislodged from the tar layer 11. Second, the tar layer 11 has penetrated the porous upper surface of the insulating layer 10 and formed a bond therewith. The bonding of the tar with the cells of the foam insulating material provides very efective waterproofing with only minimal quantities of tar being required. Lastly, despite the minimal quantities of tar involved, the result is an insulating and waterproofing roof structure which becomes in essence a unitary structure through bonding of the various layers.

It will be appreciated that particular materials have been described for purposes of illustrating the principals and features of the invention. Modifications may be made therein without departing from the spirit of the invention or the scope of the appended claims.

I claim:

1. A method of insulating and waterproofing a generally horizontal roof, comprising:

forming an insulating layer of heat-resistant foam material over the roof;

forming a layer of tar immediately over and against the insulating layer;

depositing a layer of gravel over the tar layer;

heating the tar sufficiently that the tar is drawn upwardly through the gravel to form a bond with the gravel layer and the tar forms a bond with the layer of foam material.

2. A method of insulating and waterproofing a generally horizontal roof, comprising:

forming an insulating layer of heat-resistant foam material over the roof, the foam material having at least a partially open-celled structure at an upper surface of the insulating layer;

forming a layer of tar immediately over and against the insulating layer;

depositing a layer of gravel over the tar layer;

heating the tar sufficiently that the tar penetrates the upper surface of the insulating layer to form a bond with the insulating layer and that the tar is drawn upwardly through the gravel to form a bond with the gravel layer.

3. The method of claim 2 in which the step of forming the tar layer comprises spreading molten tar over the insulating layer to an average thickness of less than about 5 millimeters.

4. The method of claim 2 in which the step of forming the tar layer comprises spreading molten tar over the insulating layer to an average thickness of less than about 2 millimeters.

5. The method of claim 2 in which the step of forming the tar layer comprises spreading molten tar over the insulating layer to an average thickness of between about 2 millimeters and 5 millimeters.

6. The method of claim 2 in which the step of forming the tar layer comprises spreading molten tar over the insulating layer to an average thickness of about 2 millimeters.

7. An insulating and waterproofing structure for a generally horizontal roof, comprising:

an insulating layer of heat-resistant foam material over the roof, the foam material having at least a partially open-celled structure at an upper surface of the insulating layer;

a layer of tar immediately over and against the insulating layer;

a layer of gravel immediately over and against the tar layer;

the tar forming a bond with the insulating layer and a bond with the gravel layers, the bonds being formed by heating the tar sufficiently to penetrate the upper surface of the insulating layer and to cause the tar to be drawn upwardly through the gravel layer.

* * * * *